US008136795B2

(12) United States Patent
Dube

(10) Patent No.: US 8,136,795 B2
(45) Date of Patent: Mar. 20, 2012

(54) CENTRIFUGALLY ACTUATED GOVERNOR

(75) Inventor: Randall S. Dube, Glastonbury, CT (US)

(73) Assignee: Otis Elevator Company, Farmington, CT (US)

( * ) Notice: Subject to any disclaimer, the term of this patent is extended or adjusted under 35 U.S.C. 154(b) by 397 days.

(21) Appl. No.: 12/520,065

(22) PCT Filed: Dec. 20, 2006

(86) PCT No.: PCT/US2006/048505

§ 371 (c)(1),
(2), (4) Date: Jun. 18, 2009

(87) PCT Pub. No.: WO2008/079106

PCT Pub. Date: Jul. 3, 2008

(65) Prior Publication Data

US 2010/0025646 A1 Feb. 4, 2010

(51) Int. Cl.
*B66D 3/08* (2006.01)

(52) U.S. Cl. ..... 254/394; 187/373; 188/180; 188/185; 192/140

(58) Field of Classification Search ..... 254/391, 254/394; 187/351, 373; 188/185, 180, 189; 192/14, 140

See application file for complete search history.

(56) References Cited

U.S. PATENT DOCUMENTS 947,150 A * 1/1910 Downey et al. ..... 192/105 CF
3,439,694 A 4/1969 Davis et al.
4,556,155 A 12/1985 Koppensteiner
4,842,105 A * 6/1989 Salmela ..... 188/185
5,217,091 A 6/1993 Shiina et al.
5,310,022 A * 5/1994 Sheridan et al. ..... 187/305
5,361,549 A 11/1994 Betts
5,377,786 A * 1/1995 Nakagawa ..... 187/287
5,967,443 A * 10/1999 Green ..... 242/381.5
6,345,696 B1 * 2/2002 Yumura ..... 187/287
6,457,569 B2 * 10/2002 Draper et al. ..... 188/180

(Continued)

FOREIGN PATENT DOCUMENTS

CN 1406857 A 4/2003

(Continued)

OTHER PUBLICATIONS

The First Office Action in counterpart Chinese Patent Application 200680056661 filed Dec. 20, 2006.

*Primary Examiner* — Emmanu M Marcelo
(74) *Attorney, Agent, or Firm* — Kinney & Lange, P.A.

(57) ABSTRACT

An assembly (20) for controlling movement of an elevator car (12), which includes a sheave (18), a first mass (32*a*, 48*a*), a second mass (32*b*, 48*b*), and a coupler (54) that provides a releasable non-elastic connection between the masses. The sheave (18) is configured to rotate about an axis of rotation (30) at a velocity related to a velocity of the elevator car (12). The first (32*a*, 48*a*) and second (32*b*, 48*b*) masses are attached to the sheave (18) at first and second pivot points (42*a*, 42*b*) radially spaced from the sheave axis of rotation (30). The coupler (54) that provides the releasable non-elastic connection between the first (32*a*, 48*a*) and second (32*b*, 48*b*) masses is configured to prevent pivotal movement of the masses at sheave angular velocities less than a first velocity and to permit pivotal movement of the masses at velocities greater than the first velocity.

24 Claims, 5 Drawing Sheets

U.S. PATENT DOCUMENTS

| | | | | |
|---|---|---|---|---|
| 6,691,834 | B2 * | 2/2004 | Sanchez et al. | 187/373 |
| 7,537,090 | B2 * | 5/2009 | Vantanen | 187/286 |
| 2001/0037920 | A1 * | 11/2001 | Draper et al. | 188/180 |
| 2004/0134726 | A1 * | 7/2004 | Sanchez et al. | 188/184 |
| 2007/0125603 | A1 * | 6/2007 | Ohira | 187/391 |
| 2008/0245617 | A1 * | 10/2008 | Michaus et al. | 187/373 |
| 2010/0059319 | A1 * | 3/2010 | Aguado et al. | 187/414 |

FOREIGN PATENT DOCUMENTS

| | | | |
|---|---|---|---|
| WO | WO2006/054385 | A1 | 5/2006 |

* cited by examiner

CENTRIFUGALLY ACTUATED GOVERNOR

BACKGROUND

The present invention relates to a device that controls elevator car speeds. More particularly, the invention relates to a centrifugally actuated governor.

A common challenge in elevator design is engineering safety systems to prevent or react to elevator malfunction. One such safety system is the speed governor. Elevator speed governors are designed to prevent elevator cars from exceeding a set speed limit. The governor is a component in an automated safety system, which is actuated when the elevator car exceeds a set speed and either signals a control system to stop the car or directly engages safeties to stop the car. One commonly known governor is a centrifugally actuated governor.

A common design of centrifugal governors used in elevator systems employs two masses connected kinematically in an opposing configuration by links and pinned to a tripping sheave rotating about a common axis. These interconnected parts create a rotating mechanism whose angular velocity is common with the sheave. The angular velocity of the rotating masses results in a centrifugal force acting to propel the masses away from the sheave axis of rotation. A rope loop wrapped partially around the sheave located at one end of the elevator hoistway, connected to the elevator car, and wrapped partially around a tensioning sheave at the opposite end of the hoistway ensures that the elevator car speed is related to the sheave angular velocity. In another commonly known design, the governor is mounted to and moves with the car. This implementation may use a static rope anchored at the top and bottom of the hoistway and wrapped partially around the tripping sheave and an adjacent idler sheave.

As the governor masses pivot about their pinned locations on the sheave, the moment of inertia of the masses changes as a function of angular velocity. The radial outward movement of the masses is limited by a device that prevents mass movement up to a set elevator car speed. The movement of the masses is typically controlled by the use of a spring connected between the sheave and one of the masses. The purpose of this arrangement is to create a spring force proportional to the extension of the spring and its inherent spring constant, which resists the centrifugal force generated by the angular velocity of the rotating sheave. The spring force maintains a controlled relative position between the masses and the sheave. Controlling the spring force as a function of the centrifugal force together with the geometry of the mechanism allows actuating the governor by controlled outward movement of the mechanism in the radial direction.

There are several limitations to using a spring connection to control the radial outward movement of the masses. First, the combination of spring and rotating inertia of the masses results in a natural frequency of vibration, which might overlap with the natural frequency of the elevator system. Overlapping natural frequencies, combined with an excitation force, for example if someone in the elevator car jumps, bounces, or rhythmically rocks the car, can cause a vibration response in the governor and thereby falsely trip the governor below a set elevator car speed. Second, this design approach requires accommodation for the manufacturing tolerances of the spring and its attachment means. Low cost commercial springs can have a wide range of spring constant tolerances, which requires spring length adjustment or pre-tensioning the spring to avoid distributions in the spring force and thereby in performance of the governor. Metal springs, which are typically used because of commercial availability and cost, have other limitations including potential spring constant changes after repeated compression/extension and susceptibility to corrosion. Polymer springs can be expensive to produce, have limited performance due to weaker material properties, are less commercially available, and can have higher tolerances.

In light of the foregoing, the present invention aims to resolve one or more of the aforementioned issues that afflict conventional governors.

SUMMARY

The present invention includes an assembly for controlling movement of an elevator car, which includes a sheave, first and second masses, and a coupler that provides a releasable non-elastic connection between the masses. The sheave is configured to rotate about an axis of rotation at a velocity related to the velocity of the elevator car. The first and second masses are attached to the sheave at first and second pivot points radially spaced from the sheave axis of rotation. The coupler that provides the releasable non-elastic connection between the first and second masses is configured to prevent pivotal movement of the masses at sheave angular velocities less than a first velocity and to permit pivotal movement of the masses at velocities greater than the first velocity.

In one embodiment of the present invention, the radial position and motion outward of the masses is controlled by a magnetic coupler between two masses. The magnetic coupler is configured to employ a permanent magnet attached to a first mass and aligned opposite to a magnetic material attached to a second mass. This arrangement results in a magnetic connection between the masses, which connection resists the centrifugal force created by rotation of the sheave. The magnetic connection may be overcome at a set sheave angular velocity as the centrifugal force on the masses exceeds the force created by the magnetic connection.

The present invention eliminates the potential natural frequency overlap between the governor and the elevator system, because the governor is actuated using a releasable non-elastic connection. In one embodiment employing a magnetic coupler between the first and second masses, a rapid separation of the masses may be possible once the centrifugal force is exceeded, because the magnetic field may decay rapidly with distance from the magnet. The present invention also eliminates the production problems associated with adjusting a spring force to calibrate an actuation speed for the governor. For example, the permanent magnet materials used in the magnetic coupler have lower tolerances associated with their force relative to spring constant tolerances and their magnetic fields are known to be stable over long periods of time.

It is to be understood that both the foregoing general description and the following detailed description are exemplary and explanatory only, and are not restrictive of the invention as claimed.

BRIEF DESCRIPTION OF THE DRAWINGS

These and other features, aspects, and advantages of the present invention will become apparent from the following description, appended claims, and the accompanying exemplary embodiments shown in the drawings, which are hereafter briefly described.

DETAILED DESCRIPTION

Figure 1:
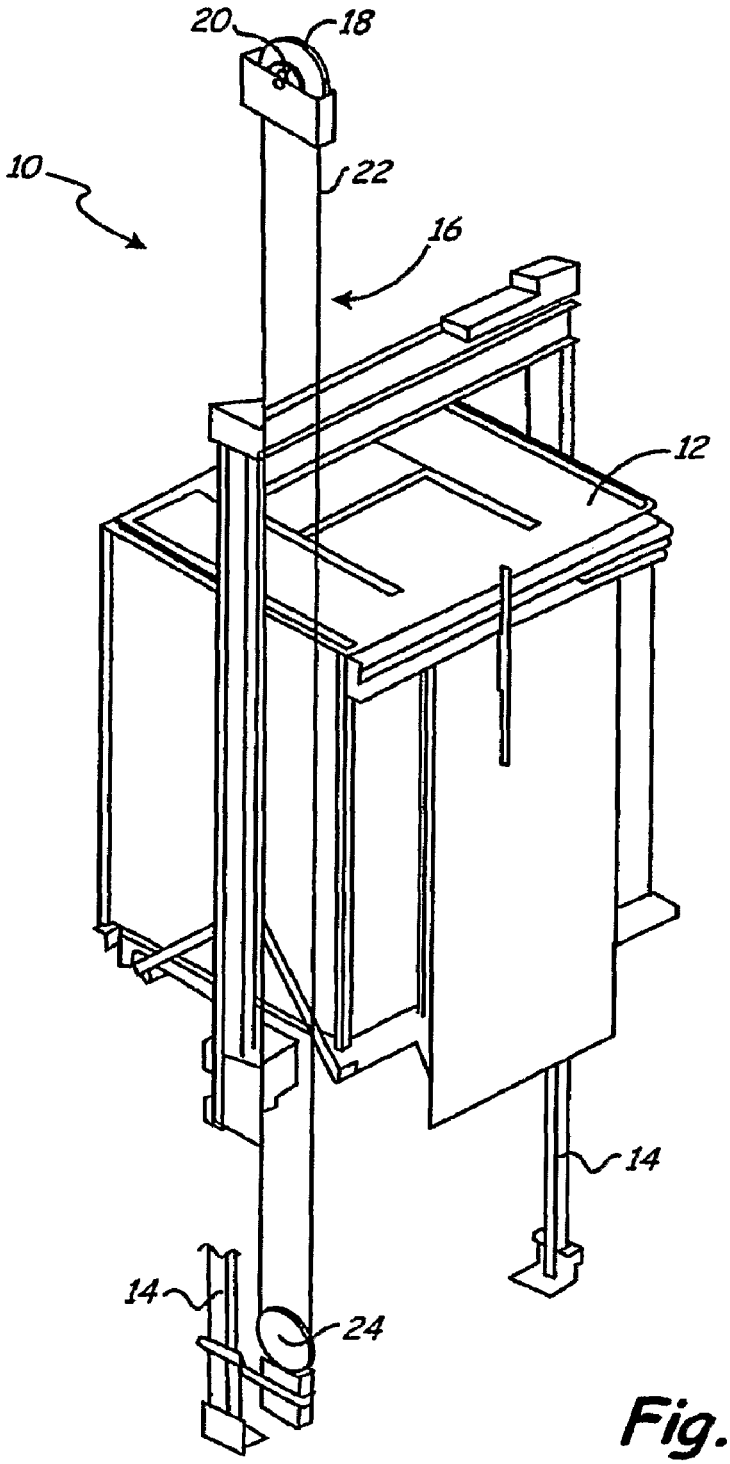
FIG. 1 is a perspective view of an elevator system including a governor.

Efforts have been made throughout the drawings to use the same or similar reference numerals for the same or like components.

FIG. 1 shows elevator system 10, which includes elevator car 12, guide rails 14, and governor assembly 16. Governor assembly 16 includes tripping sheave 18, governor 20, rope loop 22, and tensioning sheave 24. Elevator car 12 travels on or is slidably connected to guide rails 14 and travels inside a hoistway (not shown). Tripping sheave 18 and governor 20 are mounted, in this embodiment, at an upper end of the hoistway. Rope loop 22 is wrapped partially around tripping sheave 18 and partially around tensioning sheave 24 (located in this embodiment at a bottom end of the hoistway). Rope loop 22 is also connected to elevator car 12, ensuring that the angular velocity of tripping sheave 18 is related to the speed of elevator car 12.

In elevator system 10 as shown, governor assembly 16 acts to prevent elevator car 12 from exceeding a set speed as it travels inside the hoistway. Although governor assembly 16 shown in FIG. 1 is mounted at an upper end of the hoistway, governor assembly 16 may alternatively be mounted to and move with elevator car 12. Such an alternative embodiment may require a static rope anchored at the top and bottom of the hoistway and wrapped partially around tripping sheave 18 and an adjacent idler sheave.

Figure 2:
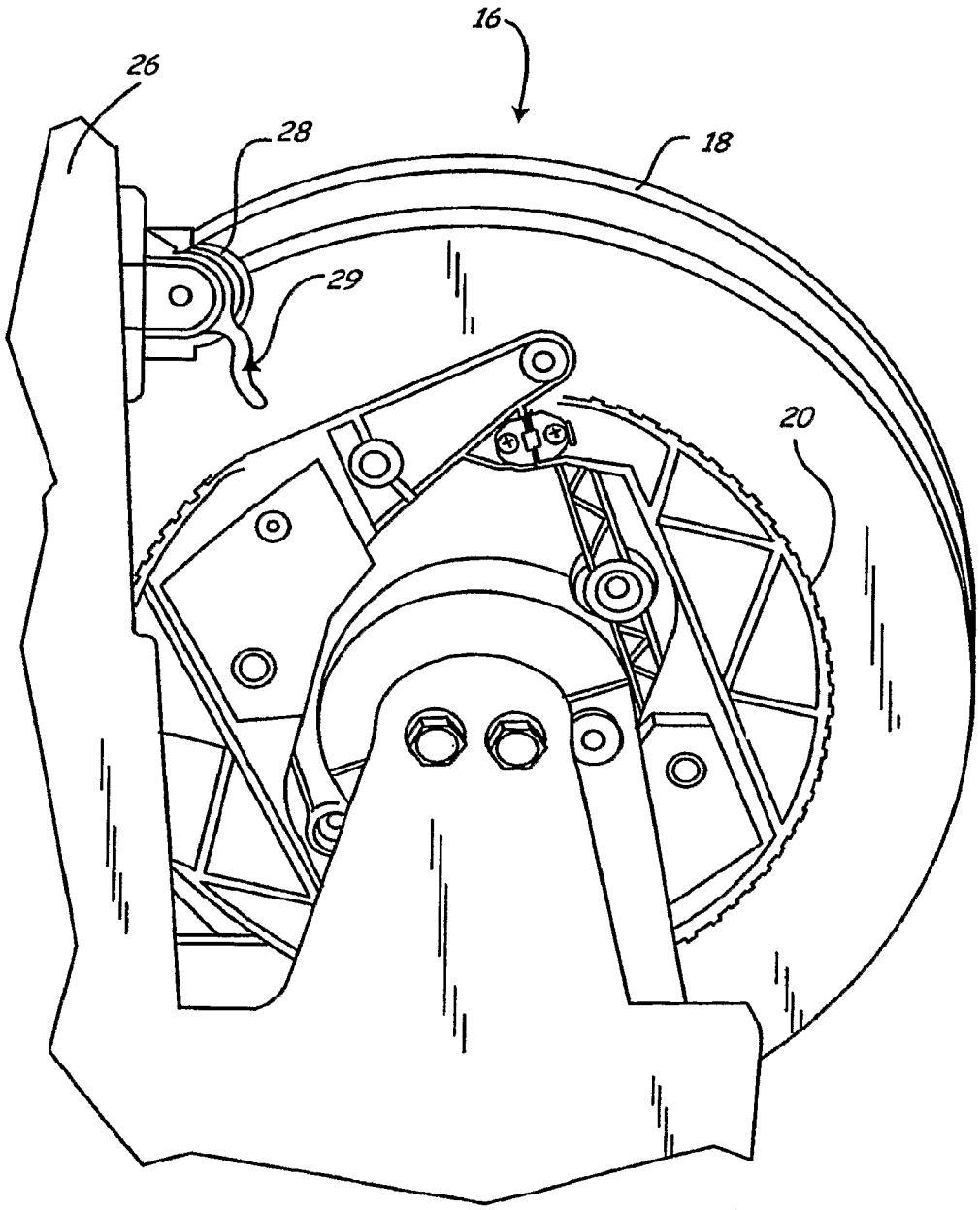
FIG. 2 is a partial view of an embodiment of a governor assembly according to the present invention, which governor assembly includes a governor with a non-elastic connection between masses.

FIG. 2 shows a partial view of governor assembly 16, which includes tripping sheave 18, governor 20, housing 26, and sensor 28 that includes a switch 29. Governor 20 is attached to tripping sheave 18, which is rotatably mounted to housing 26. Governor 20 and tripping sheave 18 rotate about a common axis 30 (shown in FIGS. 3 and 4). Also attached to housing 26 is sensor 28. Persons having ordinary skill in the art will understand that sensor 28 may be a variety of devices that signal a change in state, including a mechanically activated electrical switch 29 such as that shown in FIG. 2. Governor 20 rotates with tripping sheave 18 inside housing 26, while sensor 28 remains fixed to housing 26. Under conditions described below, one function of governor 20, when actuated, is to engage sensor 28, which in turn communicates elevator control signals to a control system (not shown) that slows or stops elevator car 12 by opening a series of relays in a safety circuit, thereby initiating a dropping of the brake and disabling the drive's ability to provide power to the motor.

Figure 3:
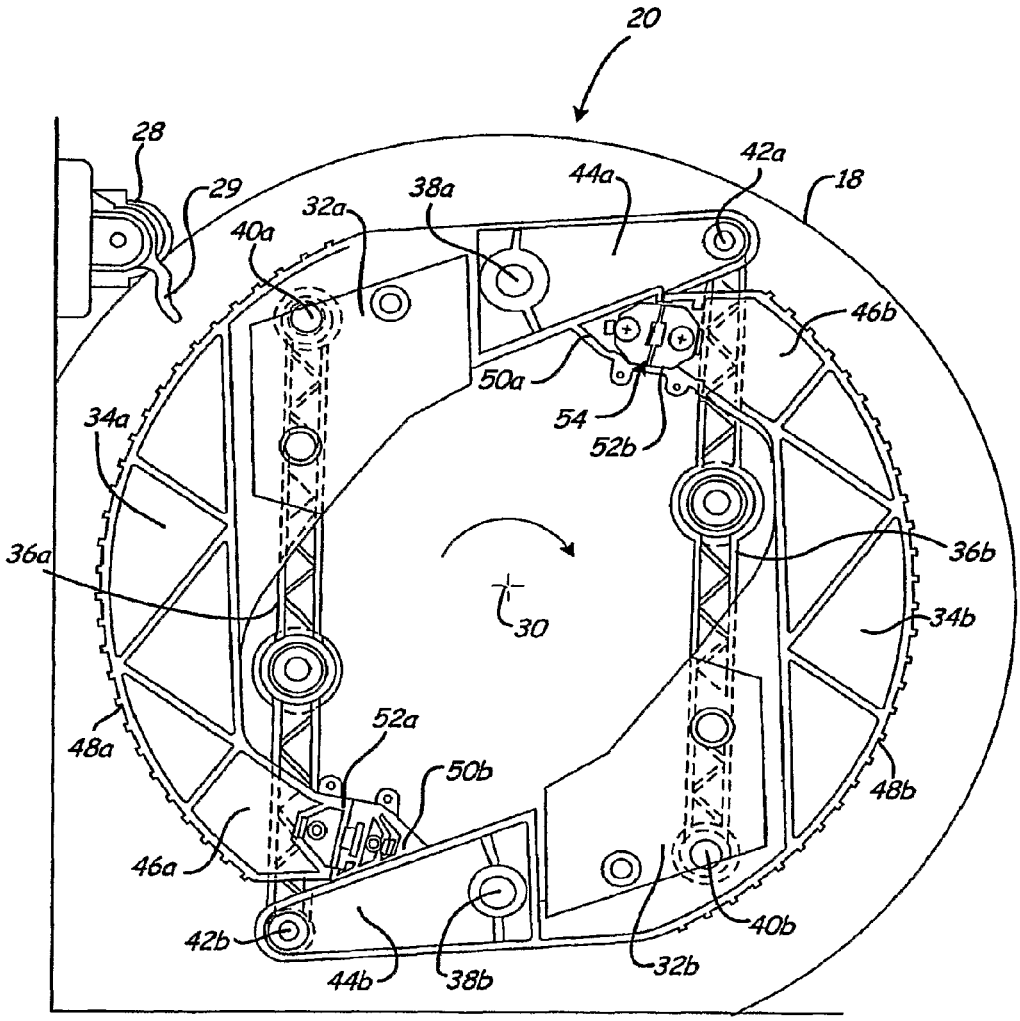
FIG. 3 is a front view of the governor shown in FIG. 2.
Figure 4:
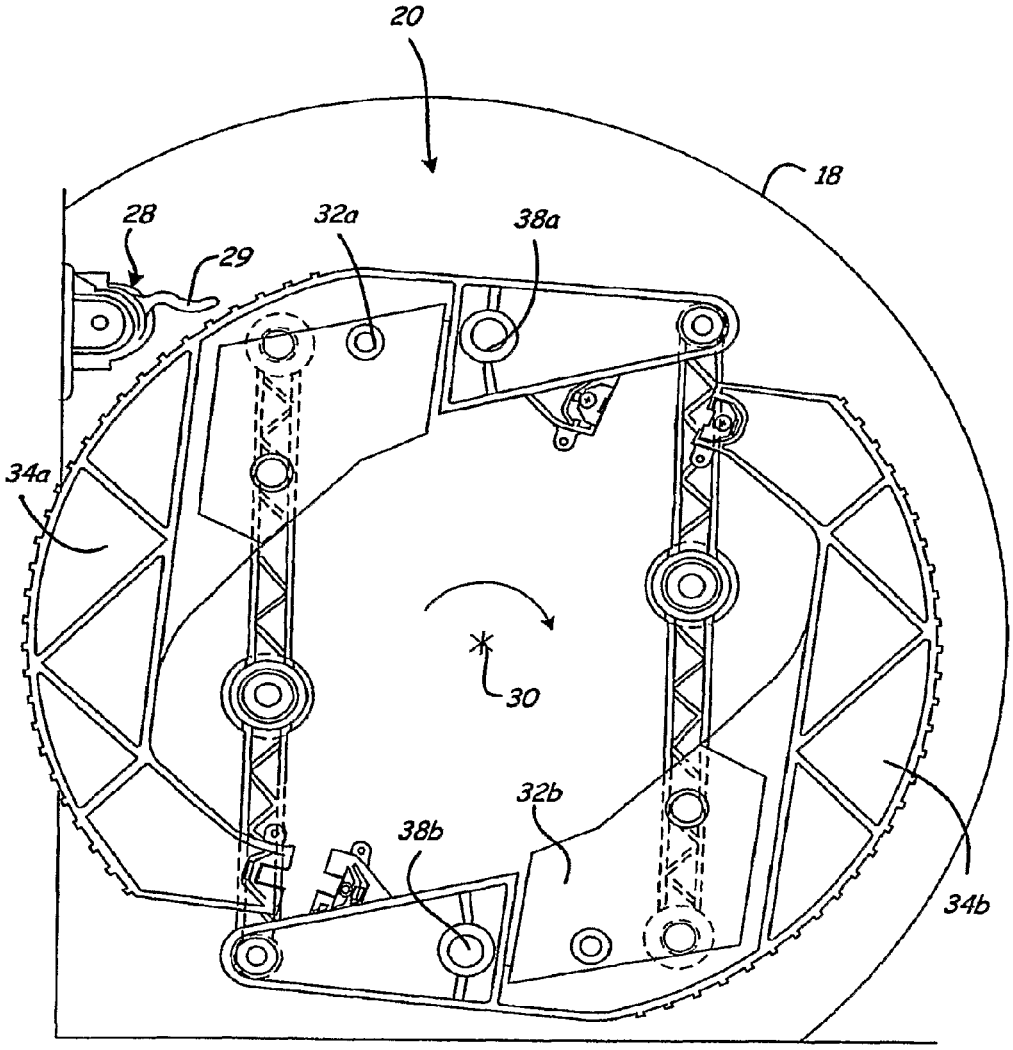
FIG. 4 shows the governor of FIGS. 2 and 3 in an actuated state.

FIGS. 3 and 4 show the front view of governor 20. FIG. 3 shows governor 20 before it has been actuated, while FIG. 4 shows governor 20 after it has been actuated. Governor 20 includes first mass 32*a*, second mass 32*b*, first mass support 34*a*, second mass support 34*b*, and links 36*a* and 36*b*. First mass 32*a* is attached to first mass support 34*a*. Second mass 32*b* is attached to second mass support 34*b*. First mass support 34*a* is pivotally attached to tripping sheave 18 at pivot point 38*a*. Second mass support 34*b* is pivotally attached to tripping sheave 18 at pivot point 38*b*. First and second mass supports 34*a* and 34*b* are pivotally attached to one another by links 36*a* and 36*b*. Link 36*a* is pivotally attached to first mass support 34*a* at pivot point 40*a* and to second mass support 34*b* at pivot point 42*b*. Link 36*b* is pivotally attached to first mass support 34*a* at pivot point 42*a* and to second mass support 34*b* at pivot point 40*b*.

In the embodiment shown in FIGS. 3 and 4, first mass support 34*a* includes proximal end 44*a*, distal end 46*a*, and arcuate outer edge 48*a*. Integral with first mass support proximal end 44*a* is proximal arm 50*a*, and integral with first mass support distal end 46*a* is distal arm 52*a*. Second mass support 34*b* includes proximal end 44*b*, distal end 46*b*, and arcuate outer edge 48*b*. Integral with second mass support proximal end 44*b* is proximal arm 50*b*, and integral with second mass support distal end 46*b* is distal arm 52*b*. First mass 32*a* may be identical to second mass 32*b*, first mass support 34*a* may be identical to second mass support 34*b*, and link 36*a* may be identical to link 36*b*. The manufacturing costs of governor 20 may be reduced in this embodiment, as the total number of unique parts is reduced by repeating masses 32*a*, 32*b*, supports 34*a*, 34*b*, and links 36*a*, 36*b* respectively in opposing configuration about axis of rotation 30. This embodiment also may simplify maintenance of governor 20 by making interchangeable masses 32*a* and 32*b*, supports 34*a* and 34*b*, and links 36*a* and 36*b* respectively.

Interconnected masses 32*a*, 32*b*, supports 34*a*, 34*b*, and links 36*a*, 36*b* create a rotating mechanism whose angular velocity is common with the angular velocity of tripping sheave 18. The angular velocity of rotating first and second masses 32*a* and 32*b* creates a centrifugal force acting to pivot the first and second masses 32*a* and 32*b* away from axis of rotation 30 about their respective pivot points 38*a*, 38*b* on tripping sheave 18. In the embodiment shown in FIGS. 3 and 4, pivot points 40*a*, 42*a* on first mass support 34*a* are equidistant from pivot point 38*a* along a first line through 40*a*, 38*a*, 42*a*. Pivot points 40*b*, 42*b* on second mass support 34*b* are equidistant from pivot point 38*b* along a second line through 40*b*, 38*b*, 42*b*. The first and second lines are parallel to one another and symmetrical about axis of rotation 30. The rotating mechanism including masses 32*a*, 32*b*, supports 34*a*, 34*b*, and links 36*a*, 36*b* is a parallelogram defined by pivot points 40*a*, 42*a*, 40*b*, and 42*b* that can skew about a line through pivot points 38*a* and 38*b* as a function of the rotational velocity of tripping sheave 18. Coupling masses 32*a*, 32*b*, supports 34*a*, 34*b*, and links 36*a*, 36*b* in the parallelogram configuration allows for controlled outward rotation of mass supports 34*a*, 34*b*, while simultaneously limiting their total rotation as a function of the geometry of the parallelogram defined by pivot points 40*a*, 42*a*, 40*b*, and 42*b*.

Masses 32*a*, 32*b*, supports 34*a*, 34*b*, and links 36*a*, 36*b* can be constructed using manufacturing techniques well known to those ordinarily skilled in the art. For example, masses 32*a*, 32*b* can be constructed from a variety of cast metal or stamped sheet metal materials. By way of another example, mass supports 34*a*, 34*b* and links 36*a*, 36*b* can be constructed from sheet metal, plastic, or a combination of metal and plastic and manufactured by stamping, casting, or injection molding.

Figure 5:
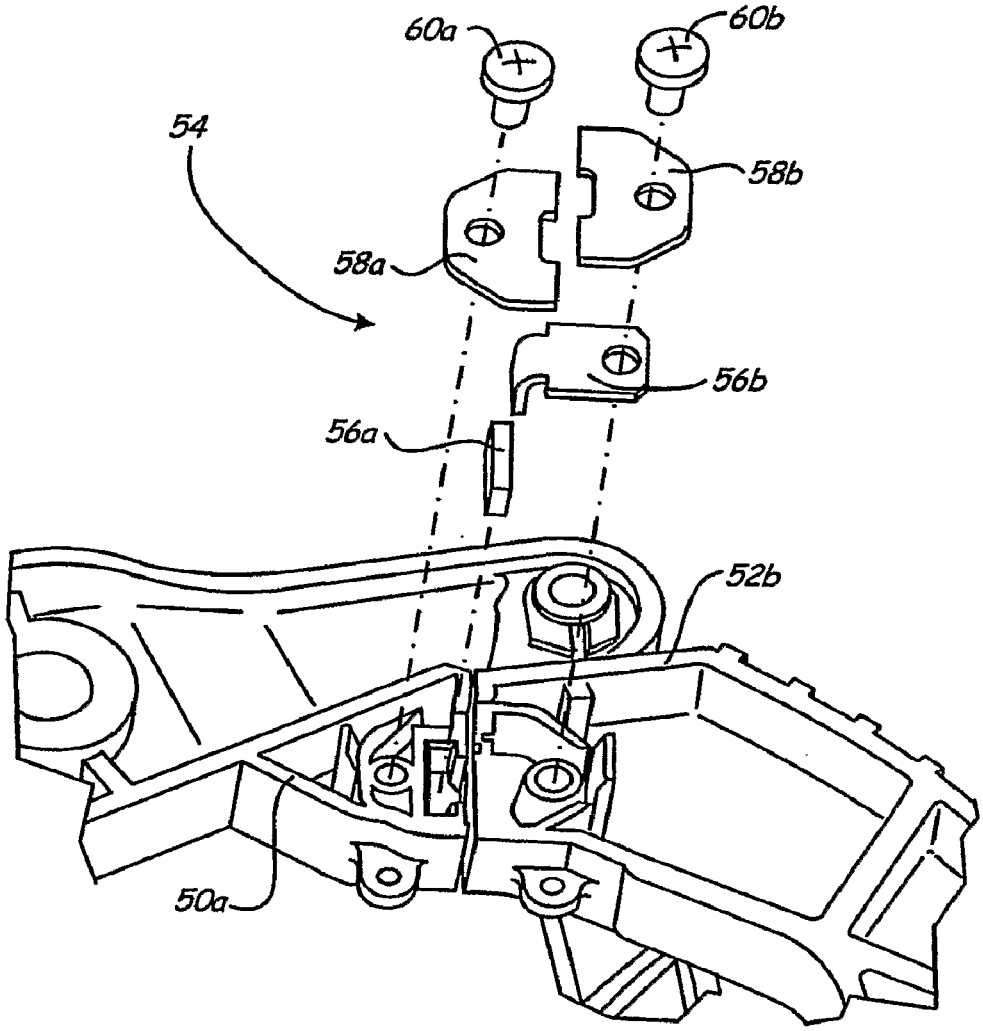
FIG. 5 is a detail exploded view of an embodiment of a non-elastic connector between the masses of the embodiment of the governor shown in FIGS. 2-4.

Governor 20 also includes releasable non-elastic connector 54 between mass supports 34*a* and 34*b*. FIG. 5 shows a detail exploded view of one embodiment of non-elastic connector 54. In the embodiment shown in FIGS. 3-5, releasable non-elastic connector 54 is a magnetic coupler, which includes first element 56*a*, second element 56*b*, first and second retaining plates 58*a*, 58*b*, and first and second retaining plate fasteners 60*a*, 60*b*. First element 56*a* is a permanent magnet carried by first mass support proximal arm 50*a*. Second element 56*b* is a ferromagnetic material carried by second mass support distal arm 52*b*. First element 56*a* is retained in first mass support proximal arm 50*a* by first retaining plate 58*a* and first retaining plate fastener 60*a*. Second element 56*b* is retained in second mass support distal arm 52*b* by second retaining plate 58*b* and second retaining plate fastener 60*b*. In other embodiments, the fasteners 60*a*, 60*b* and the retaining plates 58*a*, 58*b* could be integrally formed into joint units that, for example, snap into the associated proximal or distal arm 50*a*, 50*b*, 52*a*, 52*b*.

Connector 54 provides a magnetic connection between mass supports 34*a* and 34*b*, which resists the centrifugal force created by the rotation of sheave 18. As sheave 18 rotates at angular velocities within a defined range, mass supports 34*a*, 34*b* remain magnetically connected, and governor 20 rotates with sheave 18 without engaging sensor 28. Governor 20 is actuated when the magnetic connection provided by connector 54 is overcome at a set angular velocity of sheave 18, as the centrifugal force on masses 32*a*, 32*b* exceeds the force created by the magnetic connection.

The strength of the magnetic force created by connector 54 is inherent to the properties of the permanent magnet material of first element 56*a* and is affected by the material and geometry of second element 56*b*. For example, iron based materials formed in specific geometries can be used for second element 56*b* to concentrate or constrain the magnetic force of connector 54. In this way, the material selection and geometrical configuration of second element 56*b* minimizes the size of the permanent magnet needed for first element 56*a* and therefore minimizes the cost of first element 56*a*. Additionally, the magnetic flux or attractive force of connector 54 can be increased by addition of ferromagnetic material (typically steel) behind and/or around first element 56*a*. To optimize connector 54, the entire magnetic flux path can be analyzed and optimized to minimize the amount of permanent magnet material required for first element 56*a*. For example, a small piece of steel could be added behind the magnet. Embodiments employing a magnetic connector can include a wide variety of permanent magnets, limited only by the force capacity and size combination required and cost. For example, first element 56*a* may be a Ferrite, Alnico, NeodymiumIronBoron or Samarian Cobalt permanent magnet. Likewise, a variety of inexpensive steels, such as 1015, can be used for second element 56*b*, as their magnetic properties are all nearly the same. Alternatively, second element 56*b* can be constructed from magnetic stainless steel alloys, such as 410, 416, or 430, which offer some corrosion resistance.

FIG. 4 shows the front view of governor 20 after it has been actuated as a result of the centrifugal force created by the angular velocity of sheave 18 having overcome the releasable non-elastic connection of connector 56 between first and second mass supports 34*a* and 34*b*. Mass supports 34*a*, 34*b*, and their respective masses 32*a* and 32*b*, pivot away from axis of rotation 30 about pivot points 38*a* and 38*b*. As shown in FIG. 4, arcuate outer edge 48*a* of mass support 34*a* engages sensor 28 by tripping the switch 29. The resulting signal from sensor 28 causes a control system (not shown) to slow or stop elevator car 12. FIG. 4 shows an exaggerated rotation of mass supports 34*a*, 34*b* for purposes of clarity. In the embodiment shown in FIG. 4, first and second mass supports 34*a*, 34*b* would generally only separate by a few millimeters when governor 20 is actuated.

After actuation, to facilitate returning the masses and mass supports to their non-actuated position (i.e., the position shown in FIG. 3), a biasing member (not shown) may be provided. For example, a spring could extend between projections attached to or integral with the first and second elements of connector 56 shown in FIGS. 3-5. Examples of such projections (and holes therein) are shown in FIG. 3 on opposite sides of the labels "52*a*" and "52*b*." The projections and holes are also shown in FIG. 5. Ideally, the biasing member will enable the non-elastic connector to be rejoined and self-aligned when the sheave is driven in the opposite direction, for example, to release tripped safeties. The force exerted by the biasing member should be very small such that it has essentially no effect on the force necessary to actuate the governor but great enough to facilitate returning the governor to the non-actuated state shown in FIG. 3 when the sheave is driven in the opposite direction.

Governor assemblies generally perform two functions. First, the governor assembly reacts to a set elevator car speed by signaling a control system (e.g. via sensor 28) to slow or stop the elevator car by electrically removing power from the machine and dropping the machine brake. If the car continues to move at speeds greater than the set speed, then the governor assembly acts directly by exerting a force on a releasing carrier that exerts a force on safeties to slow or stop the car. Although it has not been specifically shown or described, those ordinarily skilled in the art will understand that a governor assembly may include two governors according to the present invention mounted to tripping sheave 18 to control movement of elevator car 12 in the hoistway. In one embodiment employing two governors, a second governor identical to governor 20 could be used. The second governor could be attached to sheave 18 on the face opposite to governor 20, for example. The first governor 20 could be actuated when elevator car 12 exceeds a first speed and the second governor could be actuated when elevator car 12 exceeds a second speed. In this embodiment, the first governor engages sensor 28 to signal a control system to slow or stop elevator car 12 and the second governor exerts a force on a releasing carrier that in turn exerts a force on safeties to slow or stop elevator car 12.

The present invention eliminates the limitations of prior art centrifugally actuated governors. Eliminating the use of a spring to connect the rotating mass supports eliminates the production problems associated with adjusting the spring force in order to achieve a calibrated actuation speed for the governor. Typically, this adjustment is required to overcome the commercial tolerances of the spring constant and the sensitivity of the spring force to the length of the spring, which is driven by tolerances associated with the spring connector assembly and its parts. Eliminating the spring eliminates the potential overlapping of natural frequencies of the governor with the elevator system. Industry code requirements can dictate the minimum sheave diameter-to-rope diameter (D/d) ratio, thus effectively restricting the size of the governor assembly in one dimension and the sheave angular velocity. Furthermore, it is generally undesirable to mount the governor to a separate rotating member driven by the sheave in order to increase the angular velocity of the governor relative to the sheave. The constraint created by some code requirements and the undesirability of mounting the governor to a separate rotating member coupled with low speed elevator operation results in spring controlled governor natural frequencies common with elevator systems. The present invention solves this natural frequency overlap, because it employs a non-elastic connector.

In the embodiment using a magnetic coupler for the non-elastic connector, a rapid separation of the mass supports is possible once the centrifugal force is exceeded because the magnetic field decays rapidly with the distance from the magnet. The rapid separation of mass supports also minimizes the time it takes the governor, once actuated, to engage the sensor and stop the elevator car. Moreover, the rapid separation of the magnet connector avoids the time associated with stretching conventional springs. It is common to create governors, which vary only by correlation of operation with particular elevator car speeds. Use of a magnetic coupler facilitates this design method by allowing a simple replacement of either the magnet or the masses to achieve the magnetic force required for a particular elevator car speed. The permanent magnet materials used in the magnetic coupler can have lower tolerances associated with their force relative to commercial spring constant tolerances and their magnetic characteristics are known to be stable over longer periods of time than the mechanical properties of springs. Commercial costs of permanent magnet materials of the size necessary to create the forces needed for the present invention are reasonable relative to the costs of comparable springs. Finally, permanent magnet materials consistent with use in embodiments of the present invention are common and routinely produced with conventional techniques.

The aforementioned discussion is intended to be merely illustrative of the present invention and should not be construed as limiting the appended claims to any particular embodiment or group of embodiments. Thus, while the present invention has been described in particular detail with reference to specific exemplary embodiments thereof, it should also be appreciated that numerous modifications and changes may be made thereto without departing from the broader and intended scope of the invention as set forth in the claims that follow.

The specification and drawings are accordingly to be regarded in an illustrative manner and are not intended to limit the scope of the appended claims. In light of the foregoing disclosure of the present invention, one versed in the art would appreciate that there may be other embodiments and modifications within the scope and spirit of the present invention. Accordingly, all modifications attainable by one versed in the art from the present disclosure within the scope of the present invention are to be included as further embodiments of the present invention. The scope of the present invention is to be defined as set forth in the following claims.

The invention claimed is:

1. An assembly for controlling movement of an elevator car, comprising:

a sheave that is configured to rotate about a sheave axis of rotation at a velocity related to a velocity of the elevator car;

a first mass attached to the sheave at a first mass pivot point radially spaced from the sheave axis of rotation;

a second mass attached to the sheave at a second mass pivot point radially spaced from the sheave axis of rotation; and a releasable non-elastic connection between the first and second masses that is configured to prevent pivotal movement of the first and second masses at sheave angular velocities less than a first velocity and to permit pivotal movement of the first and second masses at velocities greater than or equal to the first velocity, wherein the releasable non-elastic connection comprises:

a magnetic coupler having a first element carried by the first mass and a second element carried by the second mass.

2. The assembly of claim 1, wherein the first and second masses have substantially identical shapes.

3. The assembly of claim 1, wherein the first and second masses have arcuate outer edges.

4. The assembly of claim 1, wherein the first mass comprises:

a first mass member; and a first mass member support attached to the first mass member.

5. The assembly of claim 4, wherein the second mass comprises:

a second mass member; and a second mass member support attached to the second mass member.

6. The assembly of claim 1, wherein the first element includes a permanent magnet and the second element includes a magnetic material.

7. The assembly of claim 1, further comprising:

a sensor that is configured to communicate elevator car control signals upon sensing pivotal movement of the first and second masses.

8. The assembly of claim 1, wherein the mass pivot points are positioned along a common sheave diameter at substantially equal radial distances from the sheave axis of rotation.

9. The assembly of claim 8, further comprising:

a first link attached to the first mass at a first link pivot point and to the second mass at a second link pivot point; and a second link attached to the first mass at a third link pivot point and to the second mass at a fourth link pivot point.

10. The assembly of claim 9, wherein the first and third link pivot points on the first mass are substantially equidistant from the first mass pivot point along a first line, wherein the second and fourth link pivot points on the second mass are substantially equidistant from the second mass pivot point along a second line, and wherein the first and second lines are substantially parallel to one another and substantially symmetrical about the sheave axis of rotation.

11. The assembly of claim 1 further comprising a biasing member connected between the first and second masses, wherein a force exerted by the biasing member is configured to substantially reconnect the releasable non-elastic connection after the first velocity has been reached or surpassed and to not increase the first velocity at and beyond which pivotal movement of the first and second masses is configured to be permitted.

12. The assembly of claim 11, wherein the biasing member further comprises one or more springs.

13. An assembly for controlling movement of an elevator car, comprising:

a sheave that is configured to rotate about a sheave axis of rotation at a velocity related to a velocity of the elevator car;

a first mass attached to the sheave at a first mass pivot point, the first mass including a proximal arm and a distal arm;

a second mass attached to the sheave at a second mass pivot point, the second mass including a proximal arm and a distal arm; and a magnetic connection between the proximal arm of the first mass and the distal arm of the second mass that is configured to prevent pivotal movement of the first and second masses at sheave angular velocities less than a first velocity and to permit pivotal movement of the first and second masses at velocities greater than or equal to the first velocity.

14. The assembly of claim 13, wherein the first and second masses have substantially identical shapes.

15. The assembly of claim 13, wherein the first and second masses have arcuate outer edges.

16. The assembly of claim 15, wherein the first mass comprises:

a first mass member; and a first mass member support including the proximal arm and the distal arm, and wherein the first mass member is attached to the first mass member support.

17. The assembly of claim 16, wherein the second mass comprises:

a second mass member; and a second mass member support including the proximal arm and the distal arm, and wherein the second mass member is attached to the second mass member support.

18. The assembly of claim 13, further comprising:

a sensor that is configured to communicate elevator car control signals upon sensing pivotal movement of the first and second masses.

19. The assembly of claim 13, wherein the mass pivot points are positioned along a common sheave diameter at substantially equal radial distances from the sheave axis of rotation.

20. The assembly of claim 19, further comprising:

a first link attached to the first mass at a first link pivot point and to the second mass at a second link pivot point; and a second link attached to the first mass at a third link pivot point and to the second mass at a fourth link pivot point.

21. The assembly of claim 20, wherein the first and third link pivot points on the first mass are substantially equidistant from the first mass pivot point along a first line, wherein the second and fourth link pivot points on the second mass are substantially equidistant from the second mass pivot point along a second line, and wherein the first and second lines are substantially parallel to one another and substantially symmetrical about the sheave axis of rotation.

22. The assembly of claim 13 further comprising a biasing member connected between the proximal arm of the first mass and the distal arm of the second mass, wherein a force exerted by the biasing member is configured to substantially reconnect the magnetic connection after the first velocity has been reached or surpassed and to not increase the first velocity at and beyond which pivotal movement of the first and second masses is configured to be permitted.

23. The assembly of claim 22, wherein the biasing member further comprises one or more springs.

24. An assembly for controlling movement of an elevator car, comprising:

a sheave that is configured to rotate about a sheave axis of rotation at a velocity related to a velocity of the elevator car;

a first mass attached to a first face of the sheave at a first mass pivot point radially spaced from the sheave axis of rotation;

a second mass attached to the first face of the sheave at a second mass pivot point radially spaced from the sheave axis of rotation, wherein the first and second mass pivot points are positioned along a common sheave diameter at substantially equal radial distances from the sheave axis of rotation;

a first releasable non-elastic connection between the first and second masses that is configured to prevent pivotal movement of the first and second masses at sheave angular velocities less than a first velocity and to permit pivotal movement of the first and second masses at velocities greater than or equal to the first velocity;

a third mass attached to a second face of the sheave at a third mass pivot point radially spaced from the sheave axis of rotation;

a fourth mass attached to the second face of the sheave at a fourth mass pivot point radially spaced from the sheave axis of rotation, wherein the third and fourth mass pivot points are positioned along a common sheave diameter at substantially equal radial distances from the sheave axis of rotation; and a second releasable non-elastic connection between the third and fourth masses that is configured to prevent pivotal movement of the third and fourth masses at sheave angular velocities less than a second velocity and to permit pivotal movement of the third and fourth masses at velocities greater than the second velocity.

* * * * *